US008944554B2

(12) United States Patent
Kondo

(10) Patent No.: US 8,944,554 B2
(45) Date of Patent: Feb. 3, 2015

(54) LIQUID JETTING APPARATUS

(71) Applicant: Hirofumi Kondo, Aichi-ken (JP)

(72) Inventor: Hirofumi Kondo, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/222,747

(22) Filed: Mar. 24, 2014

(65) Prior Publication Data

US 2014/0292871 A1 Oct. 2, 2014

(30) Foreign Application Priority Data

Mar. 29, 2013 (JP) ..... 2013-073199

(51) Int. Cl.
*B41J 2/14* (2006.01)
*B41J 2/045* (2006.01)
*B41J 2/165* (2006.01)

(52) U.S. Cl.
CPC ..... *B41J 2/04548* (2013.01); *B41J 2/16523* (2013.01)
USPC ..... 347/14; 347/50; 347/58

(58) Field of Classification Search
CPC ..... B41J 2/04541; B41J 2/14233; B41J 2002/14491; B41J 2/14072; B41J 2/17526; H01L 41/047
USPC ..... 347/14, 19, 49, 50, 58, 86
See application file for complete search history.

(56) References Cited

U.S. PATENT DOCUMENTS

| | | | | |
|---|---|---|---|---|
| 7,896,471 | B2 * | 3/2011 | Kobayashi | 347/50 |
| 8,672,434 | B2 * | 3/2014 | Yamashita | 347/10 |
| 2003/0107624 | A1 | 6/2003 | Koga | |
| 2004/0212665 | A1 | 10/2004 | Koga | |

FOREIGN PATENT DOCUMENTS

| | | |
|---|---|---|
| JP | 2003-175588 | 6/2003 |
| JP | 2011-075387 | 4/2011 |
| JP | 2012-000871 | 1/2012 |

* cited by examiner

*Primary Examiner* — Thinh Nguyen
(74) *Attorney, Agent, or Firm* — Frommer Lawrence & Haug LLP

(57) ABSTRACT

There is provided a liquid jetting apparatus including: a main body, a liquid jetting head including a plurality of nozzles, a first board including a data generation circuit which generates a jetting control data, a second board, and first and second wiring members respectively connecting the liquid jetting head and the first and second boards, wherein the first wiring member is provided with jetting-data transmission wires, and the first wiring member is arranged to bend on an inner side of the second wiring member.

12 Claims, 13 Drawing Sheets

LIQUID JETTING APPARATUS

CROSS REFERENCE TO RELATED APPLICATION

The present application claims priority from Japanese Patent Application No. 2013-073199, filed on Mar. 29, 2013, the disclosure of which is incorporated herein by reference in its entirety.

BACKGROUND OF THE INVENTION

1. Field of the Invention

The present invention relates to a liquid jetting apparatus configured to jet liquids.

2. Description of the Related Art

Conventionally, an ink jet printer is known as a liquid jetting apparatus configured to jet liquids, and the ink jet printer is configured to carry out printing by jetting inks from nozzles. Further, in the ink jet printer, an ink jet head is mounted on a carriage moving reciprocatingly in a scanning direction, and an FFC (Flexible Flat Cable) connects the ink jet head and a control board provided in a main body of the printer.

In such a conventional ink jet printer, if the number of nozzles is increased, then there is also increased the amount of jet control data sent from the control board to the ink jet head via the FFC for controlling the ink jet from each nozzle. Therefore, in order not to reduce the print speed, it is necessary to increase the transmission speed, i.e., the transmission frequency, of the signal of the jet control data from the control board to the ink jet head. However, as the transmission frequency of the signal becomes high, the radiation noise from the FFC also increases. Especially, it is known that if in the FFC, jetting-data transmission wires for sending the signal of the jet control data coexist with wires such as wires for power supply and the like other than the jetting-data transmission wires, then the radiation noise from the FFC increases significantly. This is conceived as because a strong magnetic field is generated around the wires other than the jetting-data transmission wires, due to the influence of a magnetic field which is generated around the jetting-data transmission wires by transmitting the high-frequency signal.

SUMMARY OF THE INVENTION

An object of the present teaching is to provide a liquid jetting apparatus configured to suppress as much as possible any increase of the radiation noise from a wiring member on the occasion of having increased the transmission frequency of the jet control data.

According to an aspect of the present teaching, there is provided a liquid jetting apparatus configured to jet a liquid to a medium, including:

a main body;

a liquid jetting head which is arranged inside the main body and in which a plurality of nozzles are formed;

a first board including a data generation circuit configured to generate a jetting control data for causing the liquid jetting head to jet the liquid from each of the plurality of nozzles;

a second board;

a first wiring member which is flexible and is arranged to connect the liquid jetting head and the first board; and a second wiring member which is flexible and is arranged to connect the liquid jetting head and the second board, wherein all of jetting-data transmission wires configured to send the jetting control data generated by the data generation circuit to the liquid jetting head are formed on the first wiring member;

wherein the first wiring member is arranged to bend along a first plane such that an edge of the first wiring member in a width direction orthogonal to a longitudinal direction thereof is parallel to the first plane;

wherein the second wiring member is arranged to bend along a second plane different from the first plane such that an edge of the second wiring member in a width direction orthogonal to a longitudinal direction thereof is parallel to the second plane; and wherein the first wiring member is arranged to bend on an inner side of a bending of the second wiring member.

When the jetting control data is sent at a high frequency from a control device to the liquid jetting head via the jetting-data transmission wires, then a magnetic field is generated around the jetting-data transmission wires. On this occasion, when wires other than the jetting-data transmission wires are provided in the same wiring member provided with the transmission wires, then due to the influence of the magnetic field generated around the jetting-data transmission wires, a strong magnetic field is liable to be generated around the wires other than the jetting-data transmission wires to cause an increase in radiation noise from the wiring member. According to the present teaching, between the first and second wiring members connected to the liquid jetting head, the first wiring member is provided collectively with all the jetting-data transmission wires through which the jet control data is sent to the liquid jetting head. Therefore, the second wiring member is not provided with any jetting-data transmission wires, but is provided with only the wires other than the jetting-data transmission wires. Thus, it is possible to restrain any strong magnetic field from being generated around wires of the second wiring member due to the influence of the magnetic field generated around the jetting-data transmission wires.

Further, because the first wiring member and the second wiring member are bent on different planes from each other, it is unlikely to overlap the corresponding wire-forming surfaces of the two wiring members. Therefore, it is possible to restrain any strong magnetic field from being generated around the wires of the second wiring member due to the influence of the magnetic field generated around the jetting-data transmission wires of the first wiring member. Further, because the first wiring member is arranged on an inner side (a flexural inner side) of the second wiring member, it is possible to make the first wiring member shorter than the second wiring member.

BRIEF DESCRIPTION OF THE DRAWINGS

FIGS. 5A and 5B show positional relations between a carriage, two FFCs, a control board and a cap of FIG. 4, wherein FIG. 5A shows a state of the carriage being away from the control board while FIG. 5B shows a state of the carriage being close to the control board.

DESCRIPTION OF THE PREFERRED EMBODIMENTS

First Embodiment

Hereinbelow, a first embodiment of the present teaching will be explained.

Figure 1:
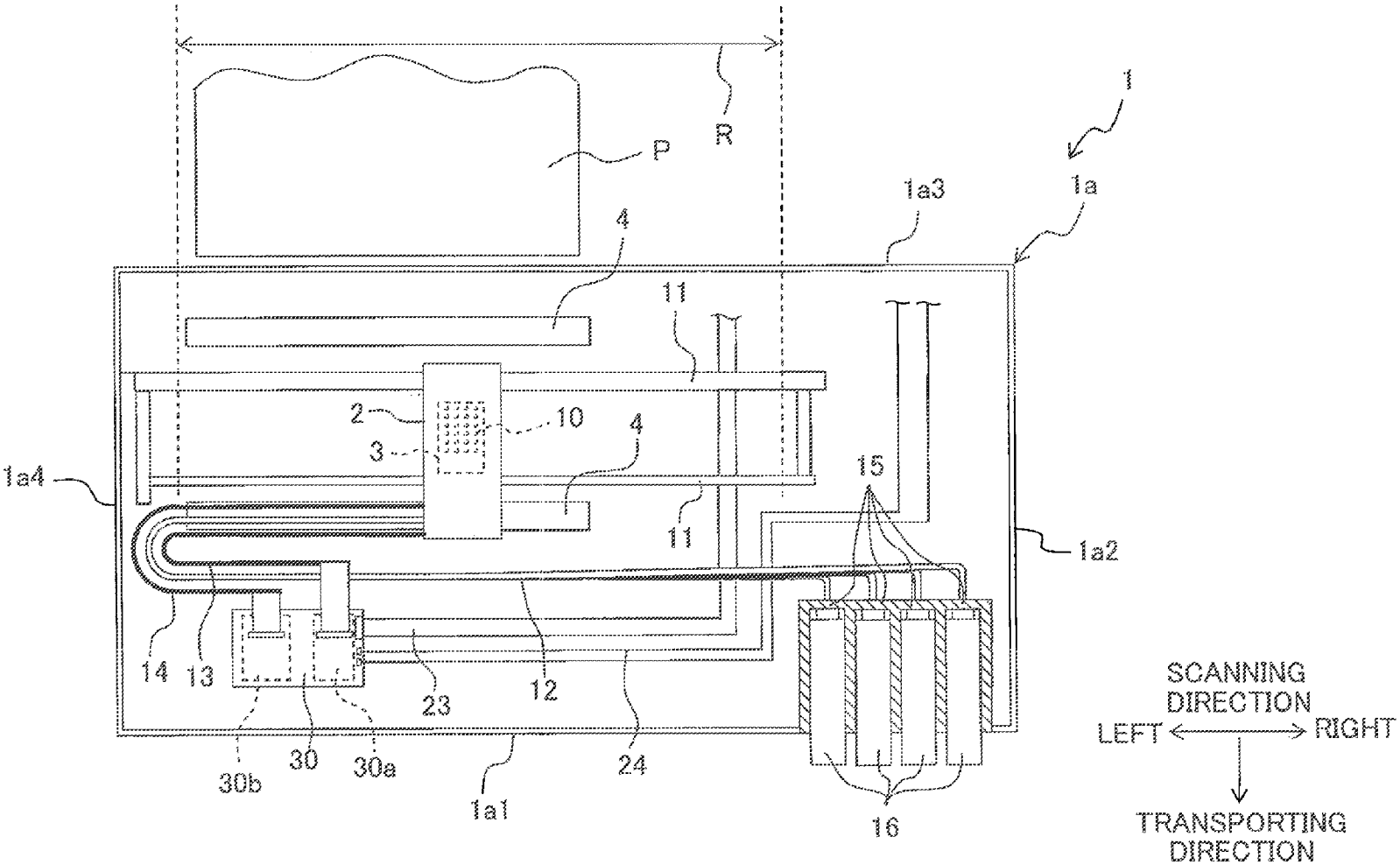
FIG. 1 is a schematic configuration diagram of a printer according to a first embodiment of the present invention.

A printer 1 according to the first embodiment is an example of the liquid jetting apparatus of the present teaching and, as shown in FIG. 1, the printer 1 includes a carriage 2, an ink jet head 3, transport rollers 4, etc. The carriage 2 moves reciprocatingly in a scanning direction within a predetermined moving range R along two guide rails 11 provided in a printer main-body 1*a* corresponding to the main-body of the present teaching. The ink jet head 3 corresponding to the liquid jetting head of the present teaching is mounted on the carriage 2 to jet inks from a plurality of nozzles 10 formed on a lower surface of the ink jet head 3. The transport rollers 4 transport sheets of recording paper P corresponding to the medium of the present teaching in a transporting direction orthogonal to the scanning direction. Then, the printer 1 carries out printing on the recording paper P by jetting the inks from the ink jet head 3 which moves reciprocatingly along with the carriage 2 in the scanning direction, while letting the transport rollers 4 transport the recording paper P in the transporting direction.

Figure 2:
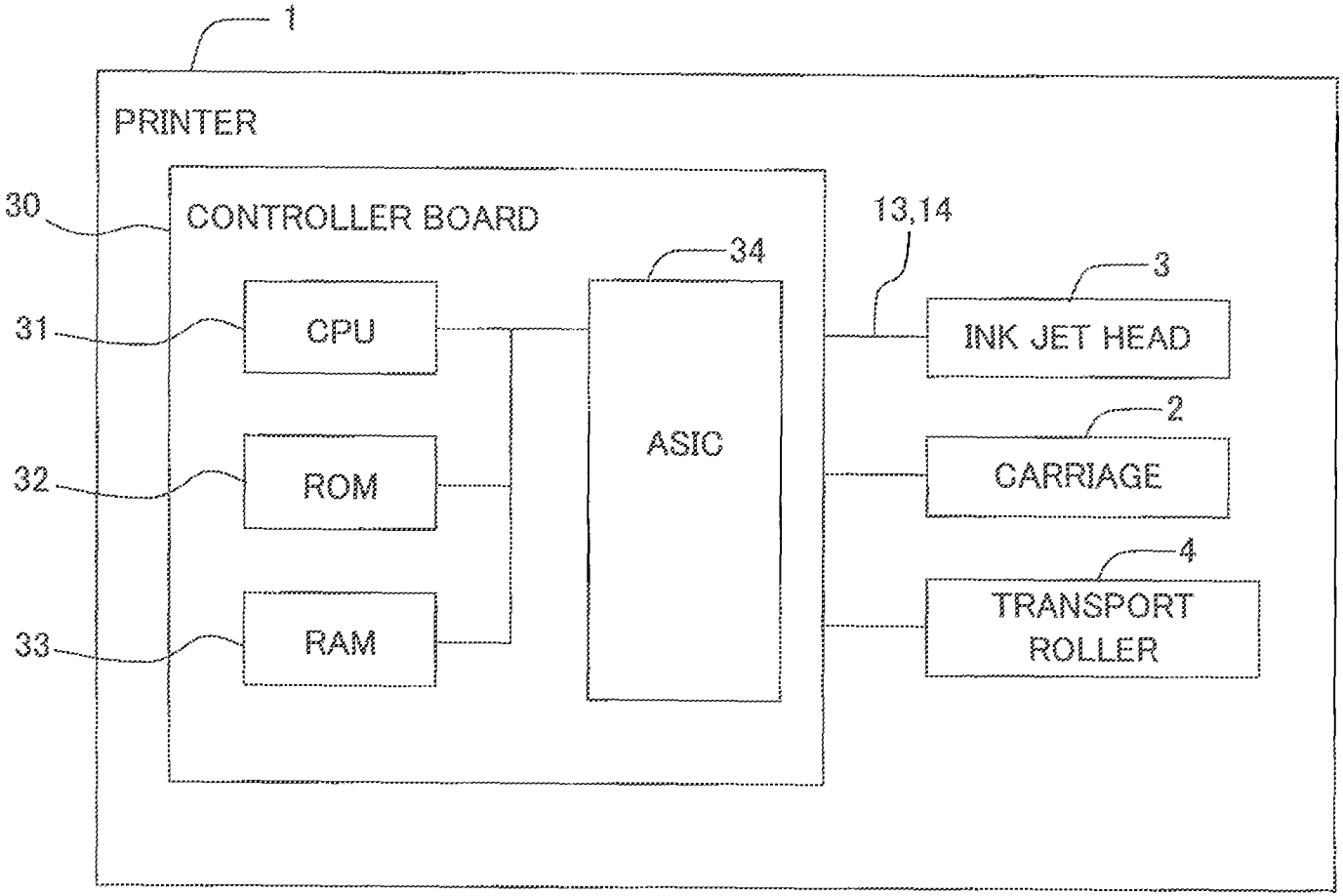
FIG. 2 is a block diagram showing a hardware configuration of the printer according to the first embodiment.

The operation of the printer 1 is controlled by a control board 30 corresponding to the common board of the present teaching. The control board 30 is arranged at an end portion of the printer main-body in on the downstream side in the transporting direction. As shown in FIG. 2, the control board 30 includes a Central Processing Unit 31 (CPU 31), a Read Only Memory 32 (ROM 32), a Random Access Memory 33 (RAM 33), an Application Specific Integrated Circuit 34 (ASIC 34), etc., and the CPU 31 and the ASIC 34 cooperate to carry out the required control for the operation of the printer 1. Note that FIG. 2 shows only one CPU 31. However, the present teaching is not necessarily limited to such configuration. For example, the control board 30 may include only one CPU 31 so that this one CPU 31 carries out processes collectively. Alternatively, the control board 30 may include a plurality of CPUs 31 so that these plurality of CPUs 31 share the processes. Further, FIG. 2 shows only one ASIC 34. However, the control board 30 may include only one ASIC 34 so that this one ASIC 34 carry out processes collectively. Alternatively, the control board 30 may include a plurality of ASICs 34 so that these plurality of ASICs 34 share the processes. Further, in the first embodiment, a data generation circuit according to the present teaching is incorporated into the ASIC 34. Here, the control board 30 is a board constructed integrally of a plurality of boards including a first board 30*a* connected with the ink jet head 3 via an FFC 13, a second board 30*b* connected with the ink jet head 3 via an FFC 14, etc.

Figure 3:
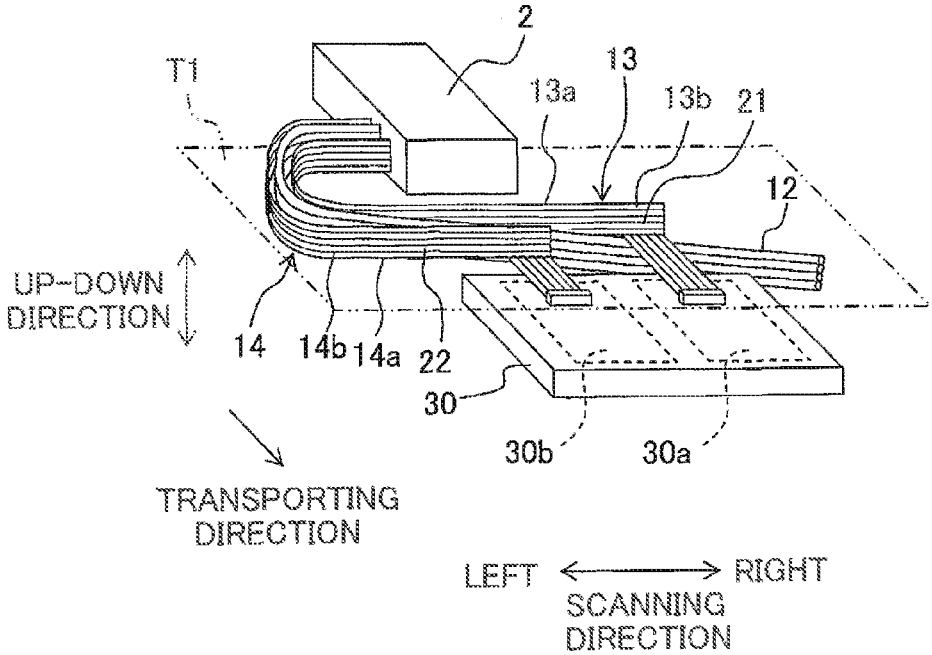
FIG. 3 shows a positional relation between a carriage, two FFCs, a control board and tubes of FIG. 1.

Next, an explanation will be given about a configuration for supplying the inks to the ink jet head 3, and a configuration for sending control signals, supplying electric power, etc., to the ink jet head 3. As shown in FIGS. 1 and 3, the ink jet head 3 is connected with four tubes 12 and the two FFCs 13 and 14. Further, illustration of the printer main-body 1*a* is omitted in FIG. 3.

The four tubes 12 corresponding to the liquid supply tube of the present teaching are aligned in a vertical or up-down direction, and pulled out leftward in the scanning direction from an end portion of the left lateral surface of the carriage 2 on the downstream side in the transporting direction. Further, the four tubes 12 are flexed midway by approximately 180 degrees on the downstream side in the transporting direction, and extend in the scanning direction between the carriage 2 and an end 1*a*1 of the printer main-body 1*a* on the downstream side in the transporting direction. The end 1*a*1 of the printer main-body 1*a* on the downstream side in the transporting direction corresponds to the one end of the main-body in a direction orthogonal to the scanning direction, of the present teaching. The ends of the four tubes 12 on the side opposite to the ink jet head 3 are connected respectively to four cartridge installation portions 15 provided in a right end portion of the printer main-body 1*a* in the scanning direction. The four cartridge installation portions 15 correspond to the retainer installation portion of the present teaching. The four cartridge installation portions 15 are aligned in the scanning direction. Ink cartridges 16 corresponding to the liquid tank of the present teaching are installed respectively in the four cartridge installation portions 15. The inks of black, yellow, cyan and magenta are respectively retained in the ink cartridges 16 in order from the ink cartridge 16 installed in the rightmost cartridge installation portion 15 in the scanning direction. By virtue of this, the inks inside the ink cartridges 16 are supplied to the ink jet head 3 via the tubes 12, and the ink jet head 3 jets these four-color inks from the plurality of nozzles 10.

The FFC 13 corresponding to the first wiring member of the present teaching is a flexible belt-like member. A plurality of wires are formed inside of the sheet-like base material formed of a synthetic resin material or the like. The FFC 13 is arranged on a horizontal plane T1 such that the width direction of the FFC 13 that is orthogonal to the longitudinal direction thereof becomes parallel to the up-down direction. By virtue of this, the FFC 13 is able to flex along the plane T1 with an edge 13*a* in the width direction being parallel to the horizontal plane T1. Further, in the following explanation, it may be described simply as "able to flex along the plane T1". The FFC 13 is pulled out leftward in the scanning direction from a portion of the left lateral surface of the carriage 2 in the scanning direction, wherein the portion is located at the downstream side in the transporting direction from a portion where the tubes 12 are pulled out. Further, the FFC 13 is bent by approximately 180 degrees on the downstream side in the transporting direction, and extends in the scanning direction between the carriage 2 and the end 1*a*1 of the printer main-body 1*a* on the downstream side in the transporting direction.

Further, the FFC 13 is bent on the downstream side in the transporting direction at a portion in the vicinity of the far end away from the ink jet head 3, and the leading end of the FFC 13 is connected to the control board 30. Further, a plurality of jetting-data transmission wires 21 are formed in the FFC 13. The jetting-data transmission wires 21 are wires for sending data of the jetting control from the control board 30 to the ink jet head 3 to give instruction of jetting the inks from the respective nozzles 10. To be explained in more detail, the jetting-data transmission wires 21 include a plurality of signal transmission wires, two of which constitute one set, for sending the signal of the data of jetting control by LVDS (Low Voltage Differential Signaling), and a plurality of ground wires arranged between the plurality of signal transmission wires and maintained at a ground potential as the potential reference for the signal sent through the signal transmission wires. For example, in the FFC 13, the jetting-data transmission wires 21 are formed at each interval of approximately 0.5 mm, including totally 23 wires. The jetting-data transmission wires 21 includes 12 signal transmission wires (i.e., 6 sets of signal transmission wires), and 11 ground wires arranged between the 12 signal transmission wires.

Similar to the FFC 13, the FFC 14 corresponding to the second wiring member of the present teaching is a flexible belt-like wiring member. The FFC 14 is arranged on the plane T1 such that the width direction of the FFC 14 becomes parallel to the up-down direction. By virtue of this, the FFC 14 is able to flex along the plane T1 with an edge 14*a* in the width direction being parallel to the plane T1. The FFC 14 is pulled out leftward in the scanning direction from a portion of the left lateral surface of the carriage 2 in the scanning direction, wherein the portion is located at the upstream side in the transporting direction to a portion where the tubes 12 are pulled out. Further, the FFC 14 is bent by approximately 180 degrees on the downstream side in the transporting direction, and extends in the scanning direction between the carriage 2 and the end 1*a*1 of the printer main-body 1*a* at the downstream side in the transporting direction. Then, in the first embodiment, the four tubes 12, the FFC 13 and FFC 14 are arranged in the above manner, the four tubes 12 and the FFCs 13 and 14 are all arranged between the carriage 2 and the end 1*a*1 of the printer main-body 1*a* at the downstream side in the transporting direction and, moreover, the four tubes 12 are positioned between the FFC 13 and the FFC 14.

Further, the FFC 14 is bent on the downstream side in the transporting direction at a portion in the vicinity of the far end away from the ink jet head 3, and the leading end of the FFC 14 is connected to the control board 30. Further, a plurality of wires 22 are formed in the FFC 14. The wires 22 are wires other than the jetting-data transmission wires 21 among the wires connected to the ink jet head 3, such as wires for supplying electric power to the ink jet head 3, wires for sending signals from sensors, etc. For example, in the FFC 14, the wires 22 including totally 10 to 12 wires are aligned at each interval of approximately 1 mm. The wires 22 includes 5 or 6 power supply wires, and totally 5 or 6 other wires, wherein the other wires includes the wires for transmitting the signals from the sensors and the ground wires maintained at the ground potential.

Further, if the lengths of the FFC 13 and FFC 14 are compared, then the FFC 13 and FFC 14 have almost the same width (the length in the up-down direction), while the FFC 13 has a shorter longitudinal length than the FFC 14.

Further, other than the FFCs 13 and 14, a harness 23 and a cable 24 are also connected to the control board 30. The harness 23 and cable 24 are pulled out rightward in the scanning direction from the control board 30, and drawn around so as not to overlap the FFCs 13 and 14, in planar view, when the carriage 2 is moving in the scanning direction. In a case that the printer 1 is a multifunction printer capable of carrying out not only printing but also image reading, the harness 23 is a wiring member for connecting the control board 30 and an unshown scanner. Further, in a case that the printer 1 is provided with a LAN port or a USB port, for example, then the cable 24 is a LAN cable for connecting the control board 30 and the LAN port, or a USB cable for connecting the control board 30 and the USB port.

In the first embodiment explained above, the signal of the jetting control data is sent from the control board 30 to the ink jet head 3 at a high frequency by LVDS. Therefore, a strong magnetic field is generated around the jetting-data transmission wires 21 through which the signal of the jetting control data is transmitted. On this occasion, suppose that the jetting-data transmission wires 21 coexist in the FFC 13 with other wires such as power supply wires and the like. Then, due to the influence of the magnetic field generated around the jetting-data transmission wires 21, a strong magnetic field is generated around the other wires. As a result, radiation noise at the FFC 13 is liable to increase significantly.

In contrast to this, as described above in the first embodiment, all of the jetting-data transmission wires 21 are formed in the FFC 13 collectively. Then, all of the wires 22 other than the jetting-data transmission wires 21 are formed in the FFC 14 collectively. By virtue of this, it is possible to restrain any strong magnetic field from being generated around the wires 22 due to the influence of the magnetic field generated around the jetting-data transmission wires 21. As a result, it is possible to suppress the radiation noise from the FFCs 13 and 14.

Further, as described above in the first embodiment, the jetting-data transmission wires 21 and the other wires 22 are provided in the separate FFCs 13 and 14. However, even in such a case, when the FFC 13 and the FFC 14 are arranged close to each other, then due to the influence of the magnetic field generated around the jetting-data transmission wires 21, a strong magnetic field is still liable to be generated around the wires 22. Further, in the first embodiment, each of the FFCs 13 and 14 is configured to bent or curve along the same plane T1. Further, a wire-forming surface 13*b* of the FFC 13 overlaps a wire-forming surface 14*b* of the FFC 14. Therefore, if supposedly the FFC 13 and the FFC 14 are arranged close to each other, then a strong magnetic field is especially more likely to be generated around the wires 22 due to the influence of the magnetic field generated around the jetting-data transmission wires 21.

In the first embodiment, however, because the tubes 12 are arranged between the FFC 13 and the FFC 14, the tubes 12 serve as a spacer to prevent the FFC 13 and the FFC 14 from approaching each other. By virtue of this, it is possible to more reliably prevent any strong magnetic field from being generated around the wires 22 due to the influence of the magnetic field generated around the jetting-data transmission wires 21.

Further, in the first embodiment, a strong magnetic field is more likely to be generated around the jetting-data transmission wires 21 through which the signal of the jetting control data is transmitted at a high frequency than around the other wires 22. In the first embodiment, the FFC 13 formed with the jetting-data transmission wires 21 is arranged to be shorter in length than the FFC 14 formed with the wires 22 other than the jetting-data transmission wires 21. In particular, the FFC 13 is arranged to curve on the inner side of the FFC 14. Therefore, it is possible for the FFC 13 to be shorter in length than the FFC 14. By virtue of this, it is possible to more effectively suppress the occurrence of noise from the FFCs 13 and 14.

Further, in the first embodiment, because the FFCs 13 and 14 are arranged between the carriage 2 and the end 1*a*1 on the downstream side in the transporting direction, it is possible to miniaturize the printer 1 rather than the case in which the carriage 2 is sandwiched between the FFC 13 and the FFC 14 in the transporting direction, Further, in the first embodiment, the FFCs 13 and 14 are arranged between the carriage 2 and the end 1*a*1 on the downstream side in the transporting direction. Therefore, instead of separately providing the first board 30*a* connected with the FFC 13 and the second board 30*b* connected with the FFC 14, it is possible to provide the control board 30 in which the first board 30*a* and second board 30*b* are formed integrally into one body.

Second Embodiment

Next, a second embodiment of the present teaching will be explained. However, the parts different from the first embodiment will be mainly explained below.

Figure 4:
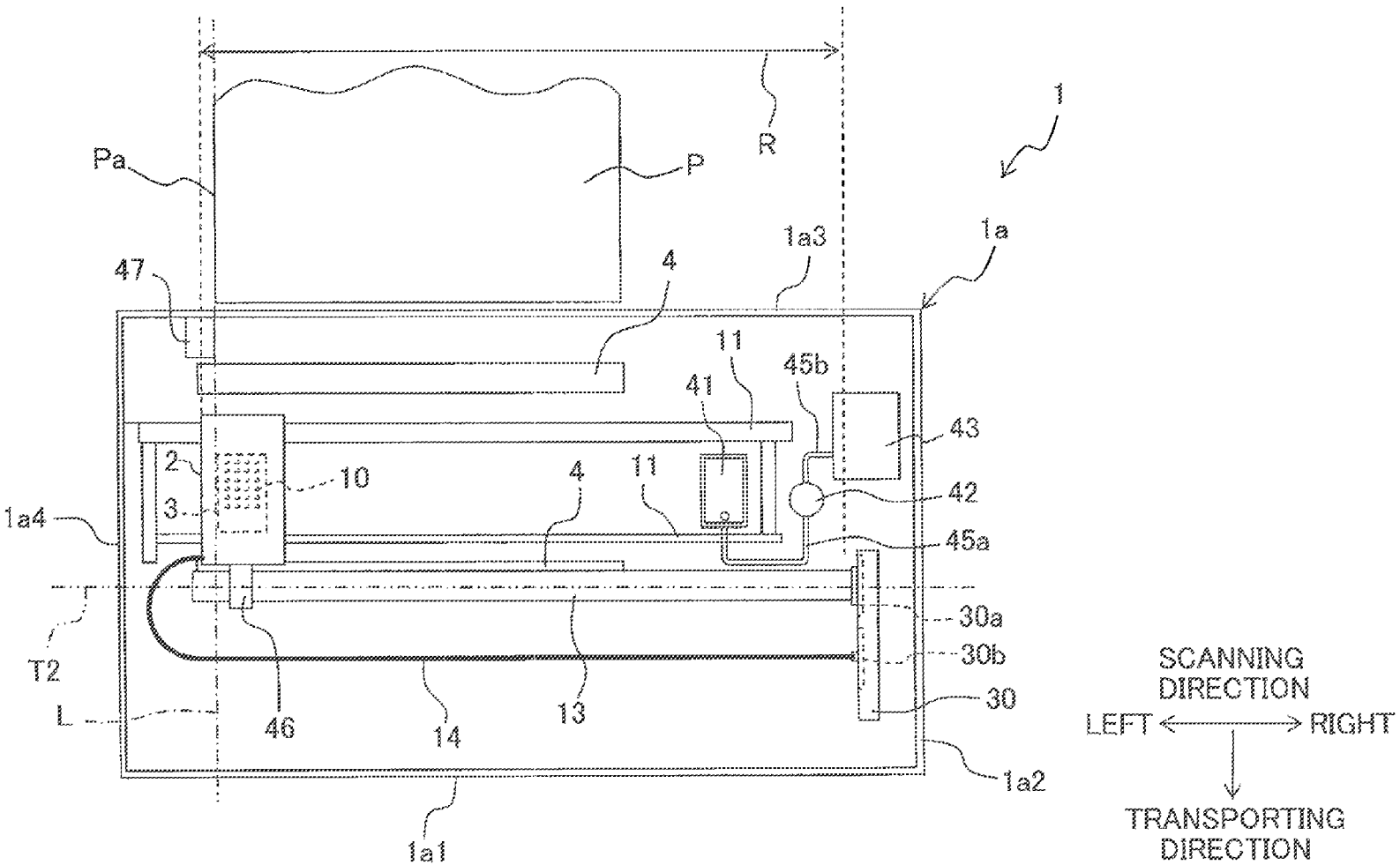
FIG. 4 is a schematic configuration diagram of a printer according to a second embodiment of the present invention.

In the second embodiment as shown in FIG. 4, the printer 1 further includes a cap 41, a suction pump 42, and a waste liquid tank 43. Further, similar to the first embodiment, the tubes 12 connect the ink jet head 3 and the cartridge installation portions 15 in the second embodiment. However, for convenience, illustration of the tubes 12 and cartridge installation portions 15 is omitted in FIG. 4.

The cap 41 corresponding to the liquid receiving member of the present teaching is arranged to face the ink jet head 3 in a case that the carriage 2 is positioned at a right end of the moving range R of the carriage 2. Here, the right end in the moving direction of the carriage 2 corresponds to one end of the moving range of the present teaching. Further, the cap 41 can be lifted up and lowered down by a lifting and lowering mechanism (not shown). When the carriage 2 is moved to the vicinity of the right end of the moving range R, the cap 41 is lifted up to cover the plurality of nozzles 10. The suction pump 42 is a tube pump or the like, and is connected with the cap 41 via a tube 45*a*. The waste liquid tank 43 is connected with the suction pump 42 via a tube 45*b*.

In the printer 1, it is possible to drive the suction pump 42 in a state in which the plurality of nozzles 10 are covered by the cap 41, in this manner, it is possible to carry out a suction purge to discharge the inks inside the ink jet head 3 from the nozzles 10 along with the air and foreign substances in the inks. The discharged inks and the like are retained in the waste liquid tank 43.

Further, in the printer 1, in a state in which the plurality of nozzles 10 are covered by the cap 41, it is possible to carry out flushing to discharge the thickened inks and the like inside the nozzles 10 by jetting the inks from the nozzles 10. Here, for the flushing, it is also necessary to send the jetting control data from the control board 30 to the ink jet head 3. In the second embodiment, the transmission frequency of the jetting control data is made lower for the flushing than for printing. Further, after the flushing, it is possible to suck the inks accumulated in the cap 41 by the flushing by driving the suction pump 42 in a state that the plurality of nozzles 10 are covered by the cap 41.

Figure 5A:
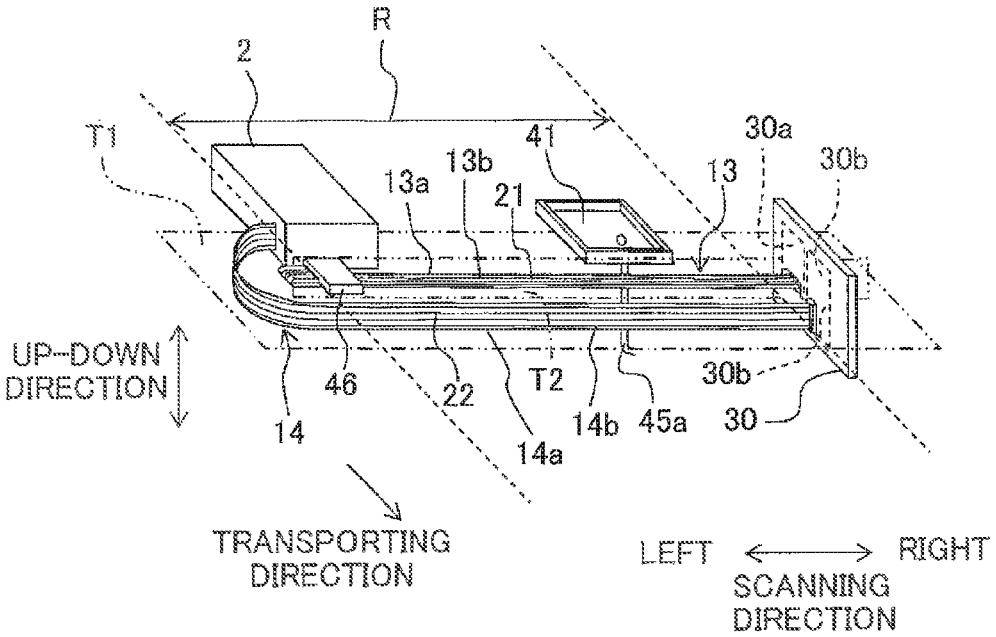
Figure 5B:
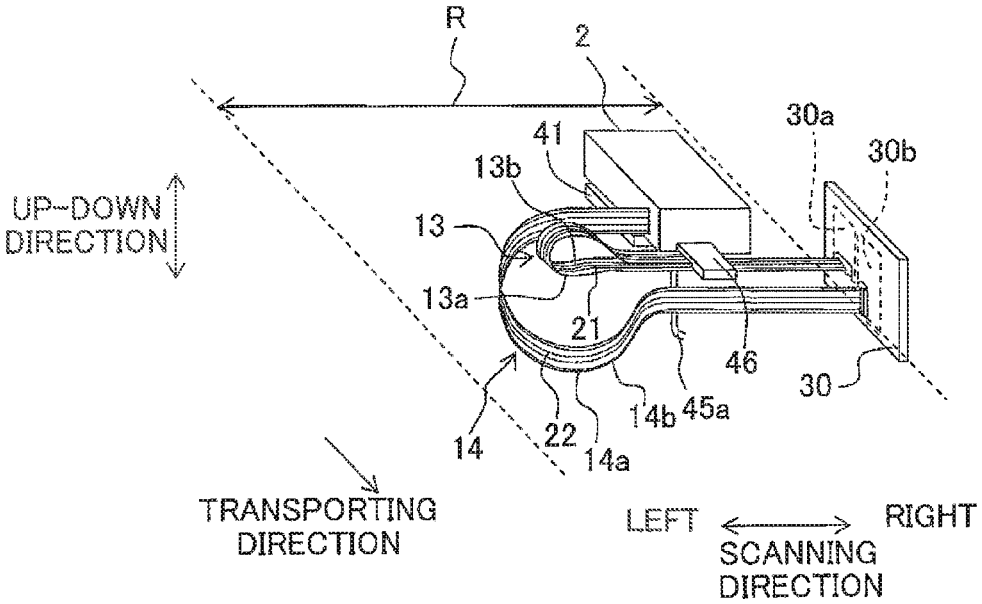

Further, in the second embodiment as shown in FIGS. 4, 5A and 5B, the control board 30 is arranged in a further right side of the printer main-body 1*a* than the right end of the moving range R for the carriage 2 in the scanning direction. By virtue of this, the control board 30 is arranged between the right end of the moving range R for the carriage 2 and an end 1*a*2 on the right side, i.e. one end of the printer main-body 1*a* in the scanning direction. Further, the carriage 2 is provided with a pullout portion 46 on an end surface on the downstream side in the transporting direction to project toward the downstream side in the transporting direction. The pullout portion 46 is shorter than the carriage 2 in length in the up-down direction, and is arranged in a position below the FFC 14.

The FFC 13 is arranged on a plane T2 orthogonal to the transporting direction such that a width direction of the FFC 13 is substantially parallel to the transporting direction. By virtue of this, the FFC 13 is configured to bent or curve along the plane T2. The FFC 13 is pulled out leftward from the pullout portion 46 in the scanning direction. Further, the FFC 13 is bent or curved by approximately 180 degrees to extend in the scanning direction through an area right below the pullout portion 46 so as to be connected to the control board 30.

In the same manner as in the first embodiment, the FFC 14 is able to bent along the plane T1. The FFC 14 is drawn leftward from an end portion of the carriage 2 on the downstream side in the transporting direction, and is bent or curved by approximately 180 degrees to extend in the scanning direction between the carriage 2 and the end 1*a*1 of the printer main-body 1*a* on the downstream side in the transporting direction so as to be connected to the control board 30.

Further, in the second embodiment, a positioning member 47 is arranged in the printer main-body 1*a* at a left end portion, i.e., the other end of the moving range R of the carriage 2. The positioning member 47 is configured to carry out positioning for the recording paper P. The recording paper P is transported by the transport rollers 4 such that an edge Pa of the recording paper P on the left side in the scanning direction is positioned at the left side to make a contact with the positioning member 47. Here, the left side in the scanning direction corresponds to a side away from the control board 30. By virtue of this, the recording paper P is positioned such that the edge Pa on the left side in the scanning direction is positioned on a straight line L shown in FIG. 4. Further, in the second embodiment, when the edge Pa along the transporting direction is positioned on the straight line L, the position of the recording paper P corresponds to the reference position of the present teaching.

Here, if the wire-forming surface 13*b* of the FFC 13 overlaps the wire-forming surface 14*b* of the FFC 14, then a strong magnetic field is likely to be generated around the wires 22 due to the influence of the magnetic field generated around the jetting-data transmission wires 21. To address this problem, in the second embodiment as described above, the FFC 13 is able to bent or curve along the plane T2 while the FFC 14 is able to bent or curve along the plane T1 different from the plane T2. Therefore, the wire-forming surface 13*b* and the wire-forming surface 14*b* are unlikely to overlap each other. Hence, it is possible to restrain any strong magnetic field from being generated around the wires 22 due to the influence of the magnetic field generated around the jetting-data transmission wires 21. Further, in the second embodiment, the plane T2, which is the arrangement plane for the FFC 13, is orthogonal to the plane T1, which is the arrangement plane for the FFC 14. Therefore, it is possible to more effectively restrain any strong magnetic field from being generated around the wires 22 due to the influence of the magnetic field generated around the jetting-data transmission wires 21.

Further, in the second embodiment as described above, the plane T2, which is the arrangement plane for the FFC 13, is orthogonal to the plane T1, which is the arrangement plane for the FFC 14. The FFC 13 and the FFC 14 are connected to the control board 30 arranged in a further right site than the right end of the moving range R of the carriage 2 in the scanning direction. In this case, as shown in FIG. 5A, when the carriage 2 is located in the vicinity of the left end of the moving range R and thus away from the control board 30, then the FFC 13 and the FFC 14 do not overlap each other in the transporting direction. In contrast to this, as shown in FIG. 5B, when the carriage 2 is located in the vicinity of the right end of the moving range R and thus close to the control board 30, then the FFC 13 and the FFC 14 overlap each other in the transporting direction because the flexed FFC 13 is heaved upward.

Therefore, in the second embodiment as described above, printing is carried out with the recording paper P being positioned at the left side as mush as possible in the scanning direction. By virtue of this, in the second embodiment, it is possible to shift the moving range of the carriage 2 in printing as mush as possible to the left side of the moving range R. By virtue of this, the FFC 13 and the FFC 14 become unlikely to overlap each other in printing, and thus it is possible to restrain any strong magnetic field from being generated around the wires 22 due to the influence of the magnetic field generated around the jetting-data transmission wires 21.

On the other hand, in the above manner, when the printing is carried out in a state that the recording paper P is positioned at the left side as mush as possible in the scanning direction, the cap 41 is arranged in the vicinity of the right end of the moving range R, as described above. Therefore, in flushing, because the FFC 13 and the FFC 14 inevitably overlap each other in the transporting direction, a strong magnetic field is more likely to be generated around the wires 22 due to the influence of the magnetic field generated around the jetting-data transmission wires 21.

In the second embodiment, the transmission frequency of the jet control data is made lower in flushing than in printing. This weakens the magnetic field generated around the jetting-data transmission wires 21. As a result, it is possible to restrain any strong magnetic field from being generated around the wires 22 due to the influence of the magnetic field generated around the jetting-data transmission wires 21.

Next, explanations will be given about a couple of modifications applying various changes to the first and second embodiments. However, explanations will be omitted as appropriate about the members and structures having the same configurations as in the first and second embodiments.

<First Modification>

Figure 6:
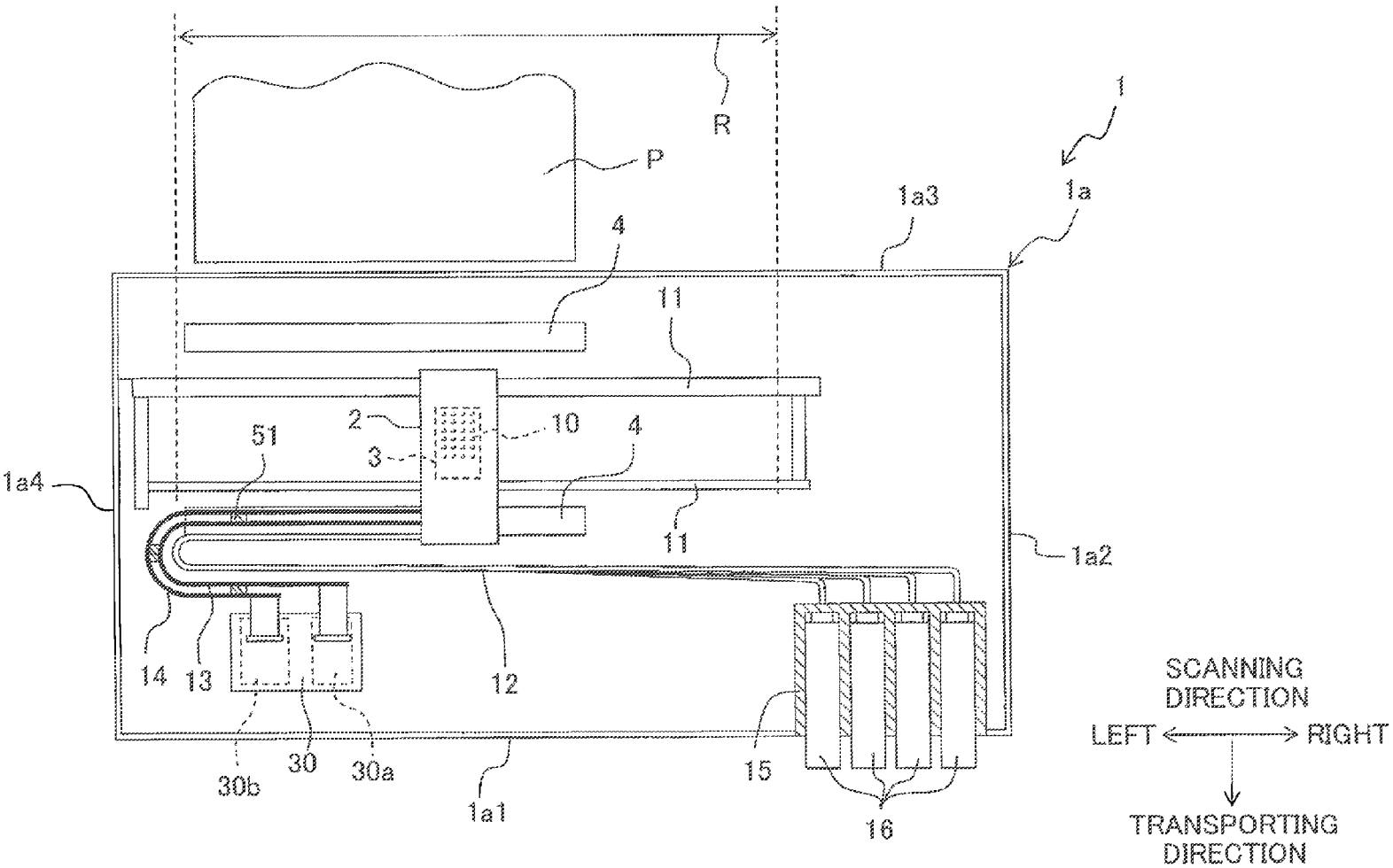
FIG. 6 is a diagram corresponding to FIG. 1, according to a first modification.

In the first embodiment, the tubes 12, which connects the ink jet head 3 and the cartridge installation portions 15, is arranged between the FFC 13 and the FFC 14 to function as a spacer spacing the FFC 13 from the FFC 14. However, the present teaching is not limited to this configuration, but may also have such a configuration as shown in FIG. 6, for example. In FIG. 6, the tubes 12 are pulled out from a portion of the left lateral surface of the carriage 2 in the scanning direction on the downstream side from the FFCs 13 and 14 in the transporting direction. On the other hand, a plurality of spacers 51 formed of sponge or the like are arranged between the FFC 13 and the FFC 14 at intervals along the longitudinal direction of the FFCs 13 and 14, and attached to each of the FFCs 13 and 14. In this case, by virtue of the spacers 51, it is also possible to prevent the FFC 13 and the FFC 14 from approaching each other.

Further, it is also possible not to provide any spacer members between the FFC 13 and the FFC 14. As described earlier, the jetting-data transmission wires 21 are all formed in the FFC 13 while the other wires 22 are all formed in the FFC 14. Therefore, in contrast to a case where the jetting-data transmission wires 21 and the wires 22 coexist in an identical FFC, it is possible to restrain any strong magnetic field from being generated around the wires 22 due to the influence of the magnetic field generated around the jetting-data transmission wires 21.

<Second Modification>

Further, the positional relation between the carriage 2, the FFCs 13 and 14, and the control board 30 is not limited to that in the first and second embodiments.

Figure 7:
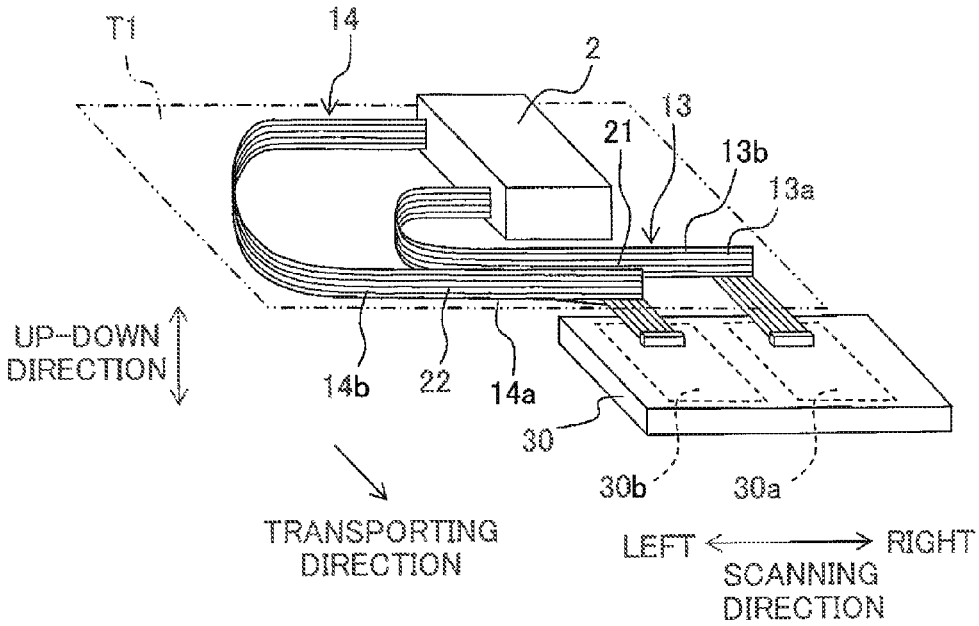
FIG. 7 is a diagram corresponding to FIG. 3, according to a second modification.

In the first embodiment, the FFC 13 is pulled out leftward in the scanning direction from an end portion of the left lateral surface of the carriage 2 in the scanning direction on the downstream side in the transporting direction. However, as shown in FIG. 7 for example, the FFC 14 may also be pulled out leftward from an end portion of the left lateral surface of the carriage 2 in the scanning direction on the upstream side in the transporting direction. In this case, because the FFC 13 and the FFC 14 are pulled out from widely separated portions of the carriage 2, it is possible to increase the distance between the FFC 13 and the FFC 14.

Referential Embodiments

Figure 8:
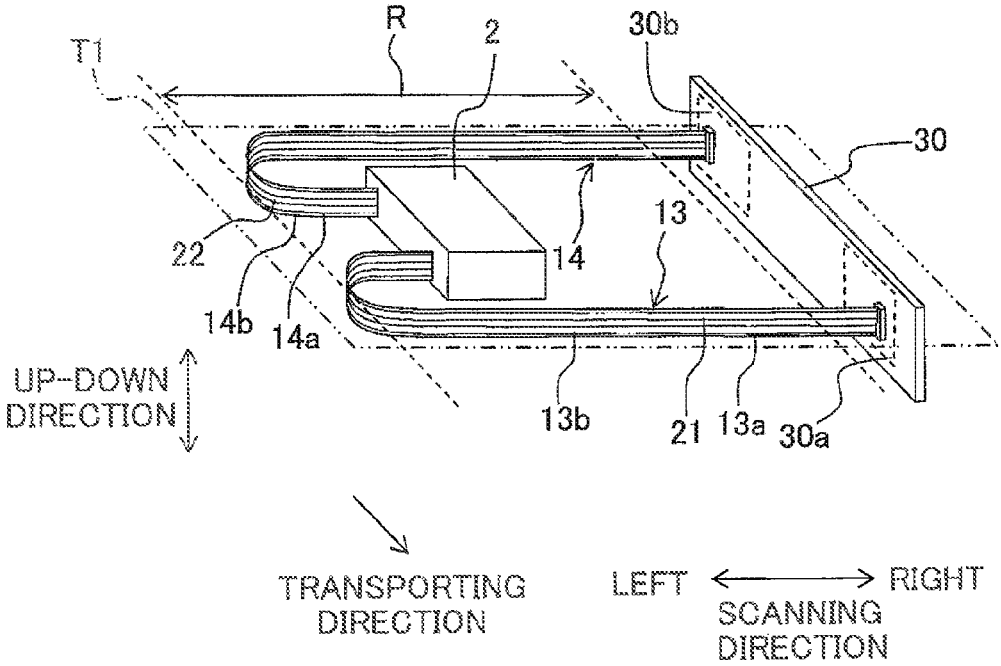
FIG. 8 is a diagram corresponding to FIG. 3, according to a referential embodiment.

Referring to FIGS. 8 to 13, a few referential embodiments associated with the present teaching will be explained below. As shown in FIG. 8, the control board 30 may also be arranged in a portion of the printer main-body 1*a*, positioned on the right side of the moving range R of the carriage 2 in the scanning direction. By virtue of this, the control board 30 is arranged between the end 1*a*2 of the printer main-body 1*a* on the right side in the scanning direction, and the right end of the moving range R for the carriage 2.

The FFC 13 is pulled out leftward in the scanning direction from an end portion of the left lateral surface of the carriage 2 in the scanning direction on the downstream side in the transporting direction. Then, the FFC 13 is bent or curved by approximately 180 degrees on the downstream side from the carriage 2 in the transporting direction to extend in the scanning direction between the carriage 2 and the end 1*a*1 (see FIG. 4) of the printer main-body 1*a* on the downstream side in the transporting direction so as to be connected to the control board 30.

On the other hand, the FFC 14 is pulled out leftward from an end portion of the left lateral surface of the carriage 2 in the scanning direction on the upstream side in the transporting direction. Then, the FFC 14 is bent by approximately 180 degrees on the upstream side to the carriage 2 in the transporting direction to extend in the scanning direction between the carriage 2 and an end 1*a*3 (see FIG. 4) of the printer main-body 1*a* on the upstream side in the transporting direction so as to be connected to the control board 30. Further, the end 1*a*3 of the printer main-body 1*a* on the upstream side in the transporting direction corresponds to the other end of the present teaching in a direction orthogonal to the scanning direction.

In this case, the FFC 13 and the FFC 14 are also pulled out from widely separated portions of the carriage 2. Further, the FFC 13 and the FFC 14 are arranged across the carriage 2 in the transporting direction. By the above configuration, it is possible to increase the distance between the FFC 13 and the FFC 14.

Figure 9:
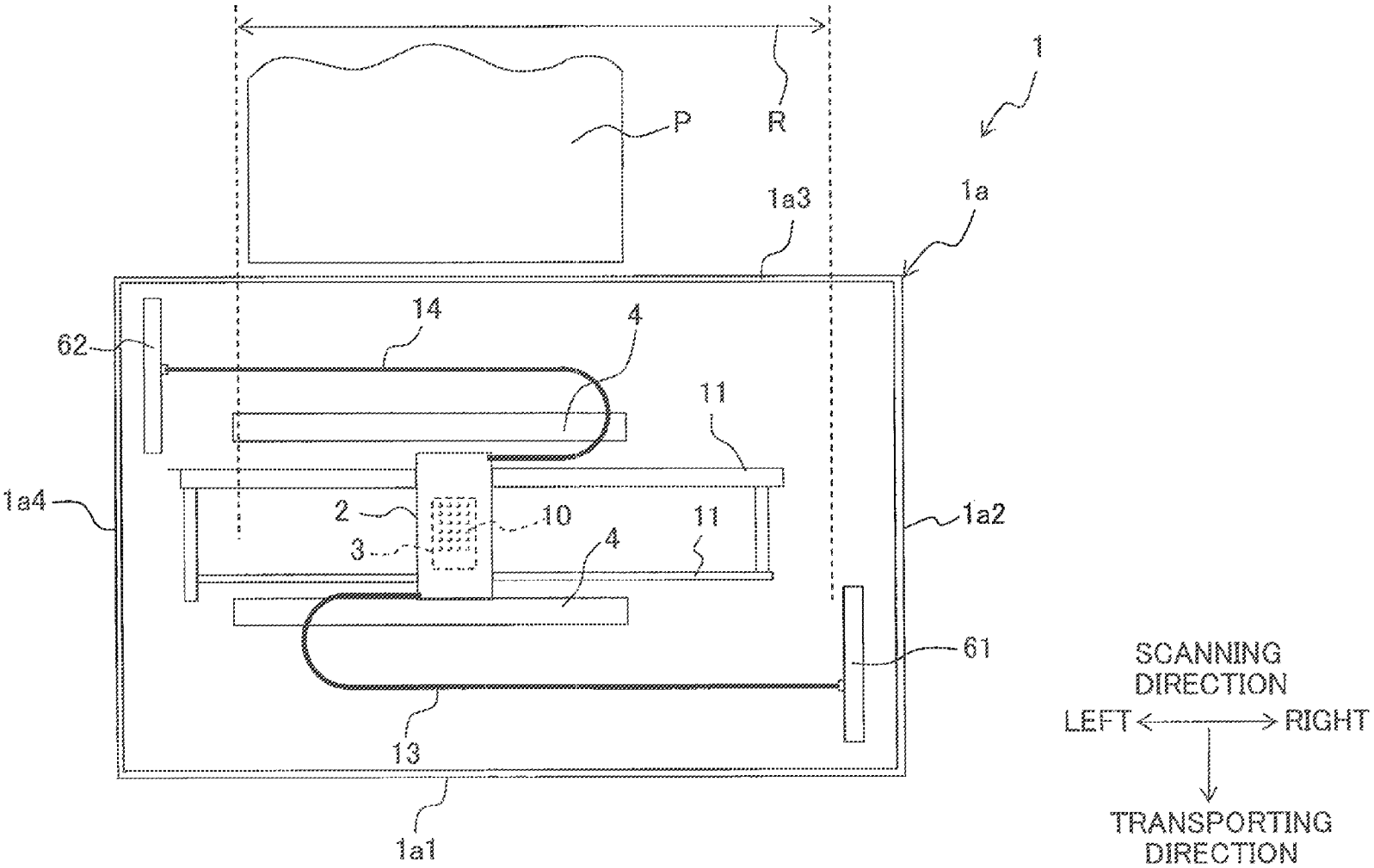
FIG. 9 is a diagram corresponding to FIG. 4, according to another referential embodiment.
Figure 10A:
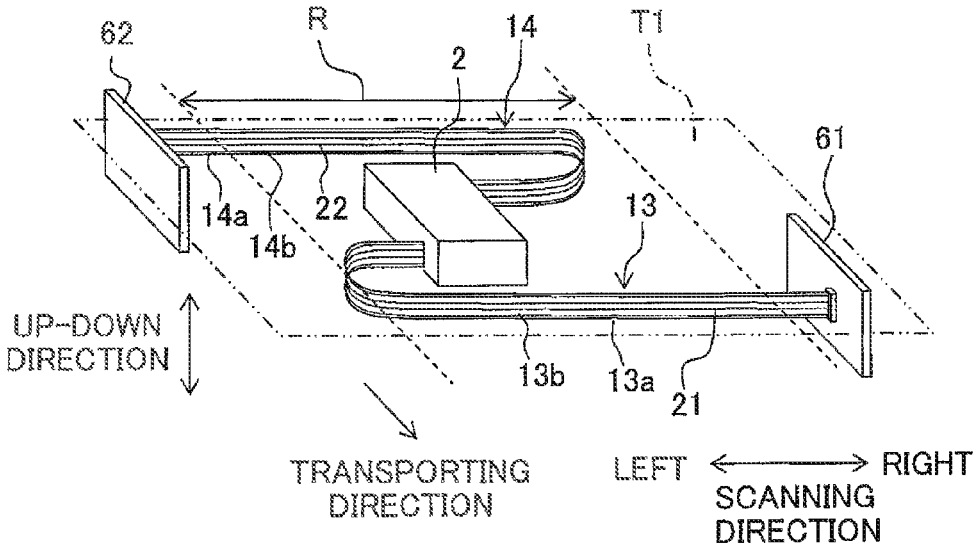
FIG. 10A is a diagram corresponding to FIG. 3, according to still another referential embodiment.

Further, as shown in FIGS. 9 and 10A, a control board 61 provided to output the jetting control data may be arranged between the end 1*a*2 of the printer main-body 1*a* on the right side in the scanning direction, and the right end the of the moving range R for the carriage 2 in the scanning direction. Further, the control board 61 corresponds to the first board of the present teaching. On the other hand, a control board 62 for supplying electric power and applying the ground potential is arranged between an end 1*a*4 of the printer main-body 1*a* on the left side in the scanning direction, corresponding to the other end of the present teaching in the scanning direction, and the left end of the moving range R of the carriage 2. The control board 62 corresponds to the second board of the present teaching.

The FFC 13 is pulled out leftward from an end portion of the left lateral surface of the carriage 2 in the scanning direction on the downstream side in the transporting direction. Further, the FFC 13 is bent by approximately 180 degrees on the downstream side in the transporting direction to extend in the scanning direction between the carriage 2 and the end 1*a*1 of the printer main-body 1*a* on the downstream side in the transporting direction so as to be connected to the control board 61. On the other hand, the FFC 14 is pulled out rightward from an end portion of the right lateral surface of the carriage 2 in the scanning direction on the upstream side in the transporting direction. Further, the FFC 14 is bent by approximately 180 degrees on the upstream side in the transporting direction to extend in the scanning direction between the carriage 2 and an end 1*a*3 of the printer main-body 1*a* on the upstream side in the transporting direction so as to be connected to the control board 62.

In this case, the FFC 13 and the FFC 14 are pulled out from the opposite lateral surfaces of the carriage 2 in the scanning direction. Further, the FFC 13 and the FFC 14 are arranged across the carriage 2 in the transporting direction. By the above configuration, it is possible to increase the distance between the FFC 13 and the FFC 14.

Further, in this case, the control board 61 connected with the FFC 13, and the control board 62 connected with the FFC 14 are arranged across the carriage 2 in the scanning direction. Therefore, the more the carriage 2 moves to the right side in the scanning direction, the closer it comes to the control board 61 and the further it departs from the control board 62. Hence, the more the carriage 2 moves to the right side in the scanning direction, the larger the FFC 13 becomes in flexion while the smaller the FFC 14 becomes in flexion. On the other hand, the more the carriage 2 moves to the left side in the scanning direction, the farther it departs from the control board 61 and the closer it comes to the control board 62. Hence, the more the carriage 2 moves to the left side in the scanning direction, the smaller the FFC 13 becomes in flexion while the larger the FFC 14 becomes in flexion. In this case, therefore, the FFC 13 and the FFC 14 never both become large in flexion at the same time. By virtue of this, the force to restore the flexed FFC 13 to its original state, and the three to restore the flexed FFC 14 to its original state never both become larger at the same time. Thus, the force received by the carriage 2 from the FFCs 13 and 14 never becomes large, and thereby it is possible to prevent placing the carriage 2 under a large load. Further, it is also possible to restrain the carriage 2 from rotation due to the force received from the FFCs 13 and 14.

Figure 10B:
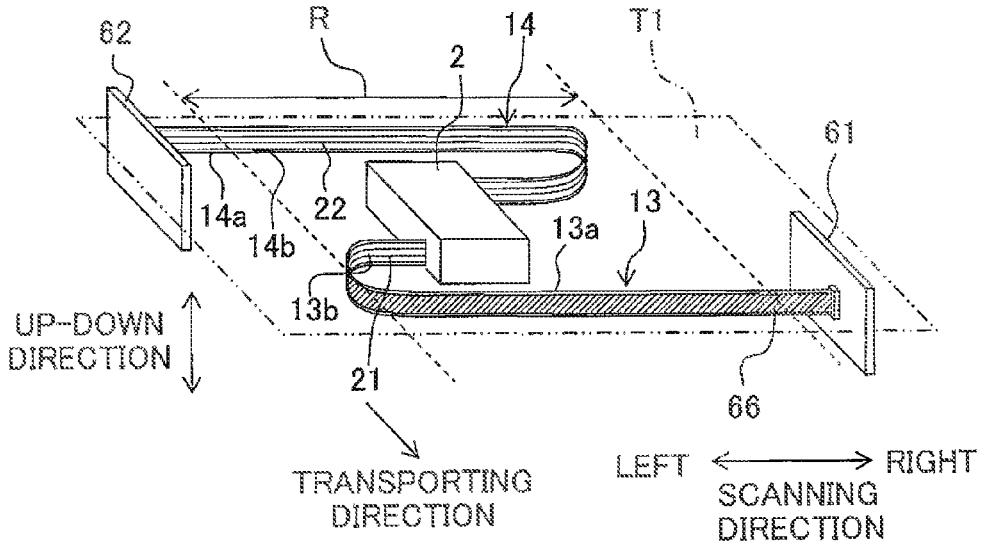
FIG. 10B is a diagram corresponding to FIG. 3, according to still another referential embodiment.

Further, as shown in FIG. 10B, a shield member 66 may be attached to the surface of one side of the FFC 13 and extend along the longitudinal direction of the FFC 13, and the jetting-data transmission wires 21 are covered by the shield member 66. The shield member 66 is a tape formed of a metallic material such as an aluminum tape, a copper foil tape, or the like.

Here, the signal voltage of the jet control data is generally lower than the voltage of the electric power supplied to the ink jet head 3, and the like. Further, the number of the jetting-data transmission wires 21 for sending the jet control data is larger than the number of the other wires 22. Therefore, the jetting-data transmission wires 21 usually have a narrower width than the wires 22. As a result, the FFC 13 may have a lower flexural rigidity than the FFC 14. If there is a difference in flexural rigidity between the FFC 13 and the FFC 14, then when the FFCs 13 and 14 are bent or curved by the same degree, a difference in magnitude occurs between the force to restore the flexed FFC 13 to its original state, and the force to restore the flexed FFC 14 to its original state. As a result, between the motions of the carriage 2 in the scanning direction to the right side and to the left side, a difference occurs in the force received by the carriage 2 from the FFCs 13 and 14, and thereby the carriage 2 is liable to an unstable travel.

To address this problem, as shown in FIG. 10B, when the shield member 66 is attached to the FFC 13 of low flexural rigidity; then when the FFCs 13 and 14 are bent or curved by the same degree, it is possible to reduce the difference in magnitude between the force to restore the flexed FFC 13 to its original state, and the three to restore the flexed FFC 14 to its original state. This diminishes the difference in the force received by the carriage 2 from the FFCs 13 and 14 between the motions of the carriage 2 in the scanning direction to the right side and to the left side, thereby stabilizing the travel of the carriage 2. Further, because the shield member 66 is attached to the surface of the FFC 13 formed with the jetting-data transmission wires 21 through which the jetting control data is transmitted at a high frequency, it is possible to suppress the radiation noise from the FFC 13.

Further, from the viewpoint of suppressing the radiation noise from the FFC 13, it is also conceivable to attach the shield member 66 to both sides of the FFC 13. In such a case, however, because two sheets of the shield member 66 formed of a metallic material are arranged to face each other, the FFC 13 is subjected to holding an unnecessary electrostatic capacitance. Hence, in the referential embodiment as shown in FIG. 10B, in order for the FFC 13 not to hold any unnecessary electrostatic capacitance, the shield member 66 is attached to only one side of the FFC 13. Further, it is needless to say that attaching the shield member 66 to one side of the FFC 13 in this manner is also applicable to each of the embodiments as shown in FIGS. 1 to 7. Further, in each of the embodiments as shown in FIGS. 1, 3, 6 and 7, if for example the shield member 66 is attached to one side of the FFC 13, that is, if the FFC 13 and the FFC 14 have some parts which face each other almost parallely, then the shield member 66 may also be attached to the FFC 13 on the side facing the FFC 14. In such a case, it is possible to efficiently restrain the radiation noise from the FFC 13 from affecting the FFC 14.

Further, the present teaching is not limited to the configuration that each of the FFCs 13 and 14 is able to flex along the plane T1.

Figure 11A:
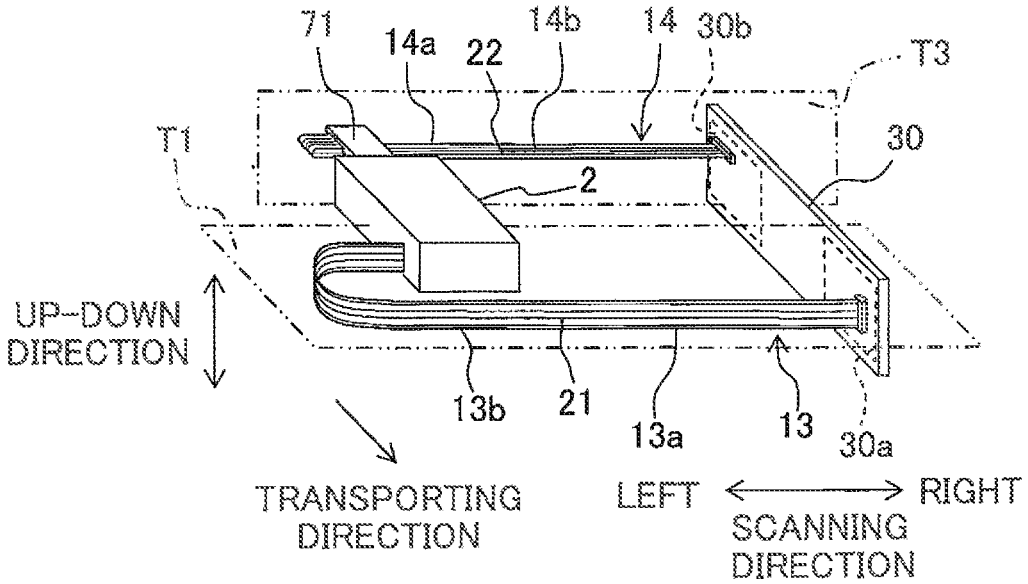
FIG. 11A is a diagram corresponding to FIG. 3, according to still another referential embodiment.

For example, such a configuration as shown in FIG. 11A is also possible. In FIG. 11A, a pullout portion 71 is provided on the upstream end of the carriage 2 in the transporting direction to project from the carriage 2 to the upstream side in the transporting direction. Similar to the pullout portion 46, the pullout portion 71 is shorter in length than the carriage 2 in the up-down direction. Then, the FFC 14 is arranged on a plane T3 orthogonal to the transporting direction such that its width direction is parallel to the transporting direction. By virtue of this, the FFC 14 is able to bent along the plane T3. The FFC 14 is pulled out leftward from the pullout portion 71 in the scanning direction. Further, the FFC 14 is bent or curved by approximately 180 degrees to extend in the scanning direction through an area right below the pullout portion 71 so as to be connected to the control board 30.

In the referential embodiment as shown in FIG. 11A, the FFC 13 is able to bent along the plane T1, while the FFC 14 is able to bent along the plane T3 different from the plane T1. By virtue of this, the wire-forming surface 13*b* and the wire-forming surface 14*b* are unlikely to overlap each other. Further, the plane T1, which is the arrangement plane for the FFC 13, is orthogonal to the plane T3, which is the arrangement plane for the FFC 14. Further, because the FFC 13 and the FFC 14 are pulled out from separated portions of the carriage 2 and, meanwhile, arranged across the carriage 2 in the transporting direction, the distance between the FFC 13 and the FFC 14 is long. By the above configuration, it is possible to restrain any strong magnetic field from being generated around the wires 22 due to the influence of the magnetic field generated around the jetting-data transmission wires 21.

Figure 11B:
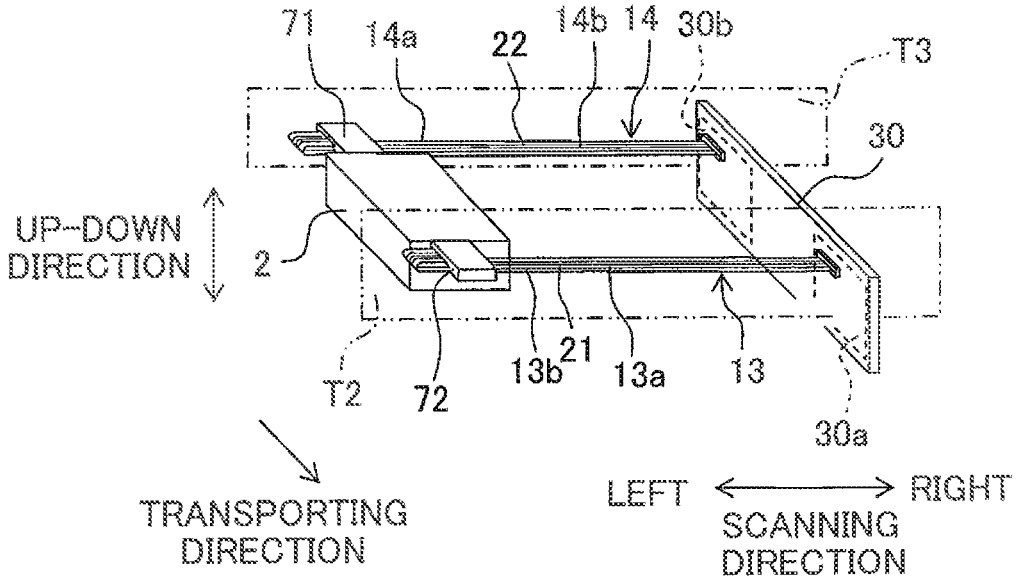
FIG. 11B is a diagram corresponding to FIG. 3, according to still another referential embodiment.

Further, as shown in FIG. 11B, a pullout portion 72 may be further provided on the downstream end of the carriage 2 in the transporting direction. Similar to the pullout portion 71, the pullout portion 72 is also shorter in length than the carriage 2 in the up-down direction. Then, the FFC 13 is arranged on the plane T2 such that its width direction is almost parallel to the transporting direction. By virtue of this, the FFC 13 is able to bent along the plane T2. The FFC 13 is pulled out leftward from the pullout portion 72 in the scanning direction. Further, the FFC 13 is bent or curved by approximately 180 degrees to extend in the scanning direction through an area right below the pullout portion 72 so as to be connected to the control board 30.

In the referential embodiment as shown in FIG. 11B, the FFC 13 is able to bent along the plane T2, while the FFC 14 is able to bent along the plane T3 different from the plane T2. Therefore, the wire-forming surface 13*b* and the wire-forming surface 14*b* are unlikely to overlap each other. Further, in the referential embodiment as shown in FIG. 11B, the FFC 13 and the FFC 14 are also pulled out from separated portions of the carriage 2 and, meanwhile, arranged across the carriage 2 in the transporting direction. Therefore, the distance between the FFC 13 and the FFC 14 is long. By the above configuration, it is possible to restrain any strong magnetic field from being generated around the wires 22 due to the influence of the magnetic field generated around the jetting-data transmission wires 21.

Figure 12A:
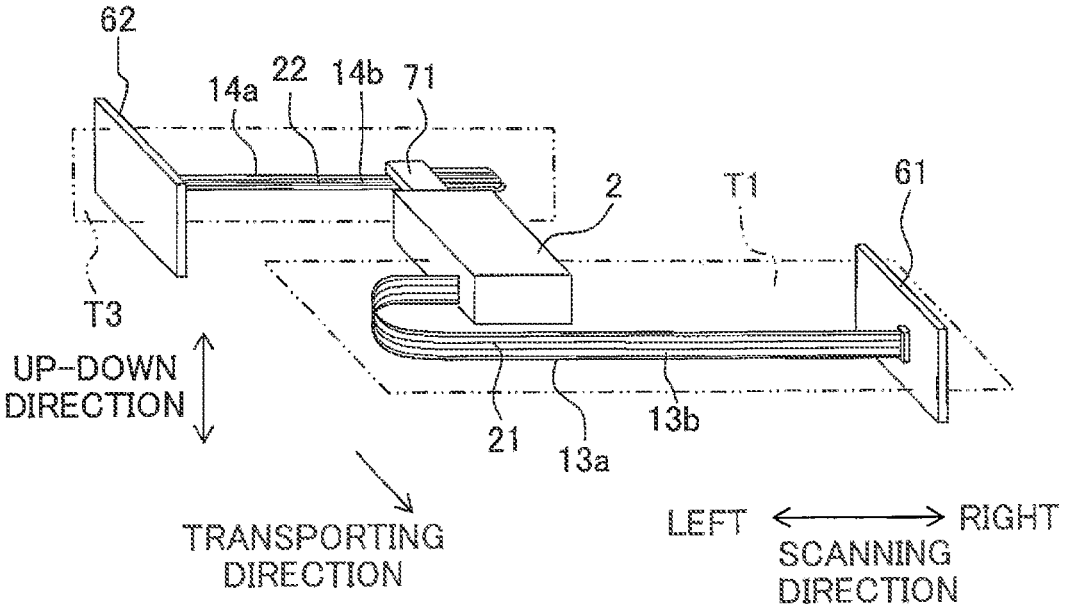
FIG. 12A is a diagram corresponding to FIG. 3, according to still another referential embodiment.

Further, as shown in FIG. 12A, the pullout portion 71 similar to that in the referential embodiment of FIG. 11A may be provided on the carriage 2. Then, the FFC 14 is able to bent along the plane T3. The FFC 14 is pulled out rightward from the pullout portion 71 in the scanning direction. Further, the FFC 14 is bent or curved by approximately 180 degrees to extend in the scanning direction through the area right below the pullout portion 71 so as to be connected to the control board 62.

In this case, too, the FFC 13 is able to bent along the plane T1, while the FFC 14 is able to bent along the plane T3 different from the plane T1. Therefore, the wire-forming surface 13*b* of the FFC 13 and the wire-forming surface 14*b* of the FFC 14 are unlikely to overlap each other. Further, the plane T1, which is the arrangement plane for the FFC 13, is orthogonal to the plane T3, which is the arrangement plane for the FFC 14. Further, in the referential embodiment as shown in FIG. 12A, because the FFC 13 and the FFC 14 are also pulled out from separated portions of the carriage 2 and, meanwhile, arranged across the carriage 2 in the transporting direction, the distance between the FFC 13 and the FFC 14 is long. By the above configuration, it is possible to restrain any strong magnetic field from being generated around the wires 22 due to the influence of the magnetic field generated around the jetting-data transmission wires 21. Further, because the FFC 13 and the FFC 14 never both become large in flexion at the same time, it is possible to restrain the carriage 2 from rotation or the like due to a large load on the carriage 2.

Further, in the referential embodiments shown in FIGS. 11A and 12A, the FFC 13 is arranged such that its width direction is parallel to the up-down direction, while the FFC 14 is arranged such that its width direction is parallel to the transporting direction. However, the present teaching is not limited to this. In the referential embodiments shown in FIGS. 11A and 12A, for instance, it is also possible that the FFC 13 is arranged such that its width direction is parallel to the transporting direction, while the FFC 14 is arranged such that its width direction is parallel to the up-down direction. In such a case, the FFC 13 is able to bent along a plane parallel to the transporting direction, while the FFC 14 is able to bent along a horizontal plane.

Figure 12B:
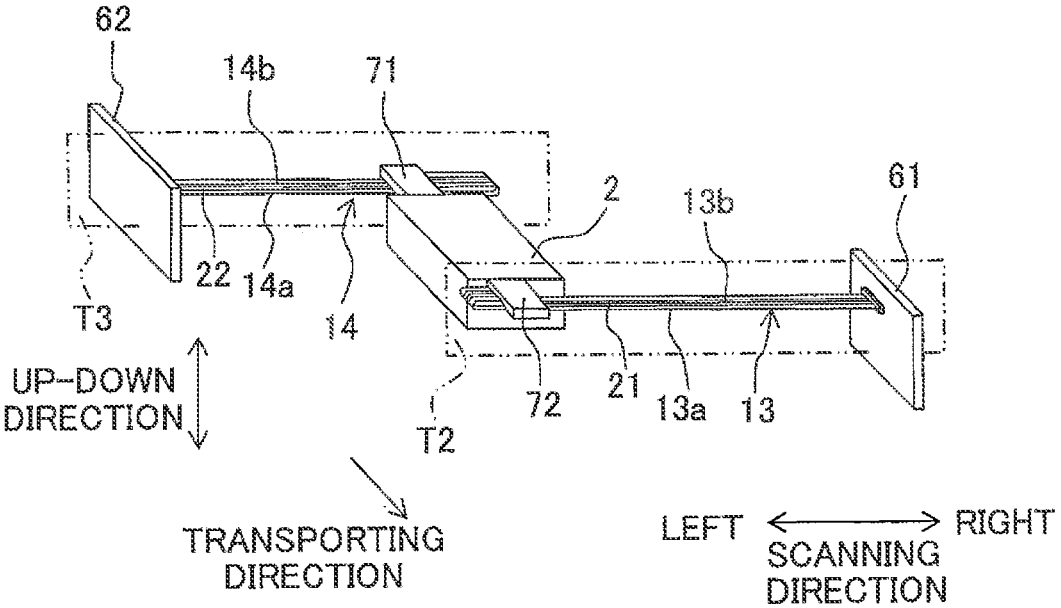
FIG. 12B is a diagram corresponding to FIG. 3, according to still another referential embodiment.

Further, as shown in FIG. 12B, the pullout portion 72 similar to that in the referential embodiment of FIG. 11B may be provided on the carriage 2. Then, in the same manner as in the referential embodiment of FIG. 11B, the FFC 13 is able to bent along the plane T2. The FFC 13 is pulled out leftward from the pullout portion 72 in the scanning direction. Further, the FFC 13 is bent or curved by approximately 180 degrees to extend in the scanning direction through the area right below the pullout portion 72 so as to be connected to the control board 61.

In the referential embodiment of FIG. 12B, too, similar to the referential embodiment of FIG. 11B, the FFC 13 is able to bent along the plane T2, while the FFC 14 is able to bent along the plane T3 different from the plane T2. Therefore, the wire-forming surface 13*b* of the FFC 13 and the wire-forming surface 14*b* of the FFC 14 are unlikely to overlap each other. Further, because the FFC 13 and the FFC 14 are pulled out from separated portions of the carriage 2 and, meanwhile, arranged across the carriage 2 in the transporting direction, the distance between the FFC 13 and the FFC 14 is long. By the above configuration, it is possible to restrain any strong magnetic field from being generated around the wires 22 due to the influence of the magnetic field generated around the jetting-data transmission wires 21. Further, because the FFC 13 and the FFC 14 never both become large in flexion at the same time, it is possible to restrain the carriage 2 from rotation or the like due to a large load on the carriage 2.

Figure 13:
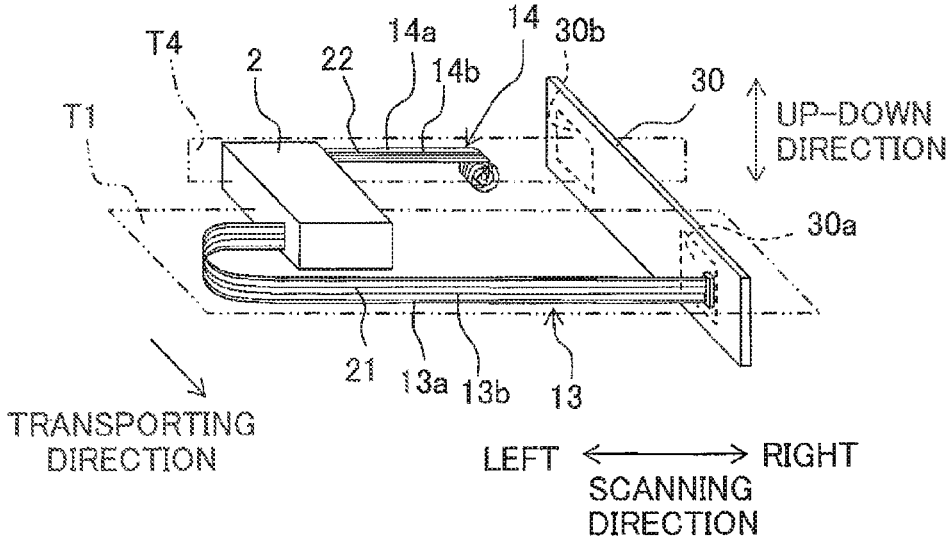
FIG. 13 is a diagram corresponding to FIG. 3, according to still another referential embodiment.

Further, the manner of bending the FFCs 13 and 14 is not limited to that explained above. As shown in FIG. 13 for example, the FFC 14 may also be arranged on a plane T4 orthogonal to the transporting direction such that its width direction is parallel to the transporting direction. By virtue of this, the FFC 14 is able to bent along the plane T4. Then, the FFC 14 is pulled out rightward in the scanning direction from an end portion of the right lateral surface of the carriage 2 in the scanning direction on the upstream side in the transporting direction. Further, the FFC 14 is curled or coiled in a middle portion to form a vortex as viewed from the transporting direction. Further, although illustration is omitted, by being folded to flex, a portion located inside of the vortex of the spirally-curled FFC 14 is pulled out in the transporting direction so as to let the leading end of the pulled-out portion be connected to the control board 30.

In this case, if the carriage 2 moves leftward in the scanning direction to depart from the control board 30, then the spirally-curled portion of the FFC 14 is pulled out leftward in the scanning direction. If the carriage 2 moves rightward in the scanning direction to approach the control board 30, then that portion is restored to the spirally-curled state.

In this case, too, the FFC 13 is able to bent along the plane T1, while the FFC 14 is able to bent along the plane T4 different from the plane T1. Therefore, in the same manner as in the referential embodiment of FIG. 8, the FFC 13 and the FFC 14 are unlikely to approach each other. Further, the plane T1, which is the arrangement plane for the FFC 13, is orthogonal to the plane T4, which is the arrangement plane for the FFC 14. Therefore, it is possible to restrain any strong magnetic field from being generated around the wires 22 due to the influence of the magnetic field generated around the jetting-data transmission wires 21.

Further, while the plane T1 is orthogonal to the planes T2 to T4 in the referential embodiments mentioned above, the plane T1 may also intersect the planes T2 to T4 at an angle different from 90 degrees. In such a case, because the arrangement plane for the FFC 13 intersects the arrangement plane for the FFC 14, it is also possible to effectively restrain any strong magnetic field from being generated around the wires 22 due to the influence of the magnetic field generated around the jetting-data transmission wires 21.

Further, in the first embodiment, the FFC 13 is shorter in length than the FFC 14. However, without being limited to this, the FFC 13 may also be either the same in length as the FFC 14 or longer than the FFC 14.

Further, in the second embodiment, flushing is carried out by jetting the inks to the cap 41 which covers the nozzles 10 when carrying out a suction purge. However, without being limited to this, a flushing foam, which is made of sponge or the like and is capable of absorbing the inks, may be provided instead of the cap 41 in the position where the cap 41 was provided, so as to carry out the flushing by jetting the inks to the flushing foam. Further, in such a case, the flushing foam corresponds to the liquid receiving member of the present teaching.

Further, in the aforementioned second embodiment, the FFC 14 is flexed to pass below the pullout portion 46. However, the FFC 14 may also be bent to pass above the pullout portion 46.

Further, in the referential embodiments shown in FIGS. 8 to 13, it is possible to interchange the positions of the FFC 13 and the FFC 14. In such a case, it is also possible to interchange the positions of the control board 61 and the control board 62 as necessary.

Further, the FFCs 13 and 14, and the boards connected with the FFCs 13 and 14 may also be arranged in positions and/or orientations different from those explained above.

Further, in the embodiments mentioned above, the jetting-data transmission wires 21 are all formed in the FFC 13, while the wires 22 other than the jetting-data transmission wires 21 are all formed in the FFC 14. However, without being limited to this, parts of the wires 22 may also be formed in the FFC 13. In such a case, a strong magnetic field is more likely to be generated around the parts of the wires 22 formed in the FFC 13 due to the influence of the magnetic field generated around the jetting-data transmission wires 21. Even in this case, however, because all of the jetting-data transmission wires 21 are formed collectively in the FFC 13, it is still possible to restrain any strong magnetic field from being generated around the wires 22 formed in the FFC 14 due to the influence of the magnetic field generated around the jetting-data transmission wires 21.

Further, the above explanations were made with the embodiments applying the present teaching to an ink jet printer including a so-called serial ink jet head which jets inks from nozzles while moving reciprocatingly along with a carriage in a scanning direction. However, without being limited to this, it is also possible to apply the present teaching to ink jet printers including a so-called line head which extends in the scanning direction over the entire length of the recording paper P. Further, it is also possible to apply the present invention to liquid jetting apparatuses other than ink jet printers jetting liquid other than ink.

What is claimed is:

1. A liquid jetting apparatus configured to jet a liquid to a medium, comprising:

a main body;

a liquid jetting head which is arranged inside the main body and in which a plurality of nozzles are formed;

a first board including a data generation circuit configured to generate a jetting control data for causing the liquid jetting head to jet the liquid from each of the plurality of nozzles;

a second board;

a first wiring member which is flexible and is arranged to connect the liquid jetting head and the first board; and a second wiring member which is flexible and is arranged to connect the liquid jetting head and the second board, wherein all of jetting-data transmission wires configured to send the jetting control data generated by the data generation circuit to the liquid jetting head are formed on the first wiring member;

wherein the first wiring member is arranged to bend along a first plane such that an edge of the first wiring member in a width direction orthogonal to a longitudinal direction thereof is parallel to the first plane;

wherein the second wiring member is arranged to bend along a second plane different from the first plane such that an edge of the second wiring member in a width direction orthogonal to a longitudinal direction thereof is parallel to the second plane; and wherein the first wiring member is arranged to bend on an inner side of a bending of the second wiring member.

2. The liquid jetting apparatus according to claim 1, wherein the first plane intersects the second plane.

3. The liquid jetting apparatus according to claim 1, further comprising a carriage configured to move in a scanning direction, wherein the liquid jetting head is mounted on the carriage; and the first wiring member and the second wiring member are both arranged between the carriage and one end of the main body in a direction orthogonal to the scanning direction.

4. The liquid jetting apparatus according to claim 3, further comprising a common board in which the first board and the second board are formed integrally into one body, wherein the first wiring member and the second wiring member are connected to the common board.

5. The liquid jetting apparatus according to claim 4, further comprising a transport portion provided to transport the medium in a transporting direction intersecting the scanning direction, wherein the common board is arranged between a moving range of the carriage and one end of the main body in the scanning direction; the first plane is parallel to both the scanning direction and the transporting direction; the second plane is parallel to the scanning direction and orthogonal to the first plane; and the transport portion is configured to transport the medium such that the medium is positioned to a reference position which is set at an other end within the moving range for the carriage in the scanning direction to determine an edge position of the medium on the other end in the scanning direction.

6. The liquid jetting apparatus according to claim 5, further comprising a positioning member in a form of a projection which is arranged in the reference position on the upstream side to the carriage in the transporting direction.

7. The liquid jetting apparatus according to claim 5, further comprising a controller which is configured to control the liquid jetting head, and a liquid receiving member arranged in the main body at the one end of the moving range of the carriage in the scanning direction, wherein the controller is configured such that in a case that the liquid jetting head faces the liquid receiving member, the liquid jetting head carries out flushing toward the liquid receiving member from the plurality of nozzles; and in a case that the liquid jetting head carries out the flushing, the controller is configured to lower a transmission frequency of the jetting control data which is sent from the data generation circuit to the liquid jetting head via the jetting-data transmission wires of the first wiring member, as compared with a case that the liquid jetting head jets the liquid toward the medium.

8. The liquid jetting apparatus according to claim 3, further comprising:

a tank installation portion configured to install a liquid tank which retains the liquid to be supplied to the liquid jetting head; and a flexible liquid supply tube connecting the carriage and the tank installation portion, wherein the liquid supply tube is arranged between the carriage and the one end of the main body in the direction orthogonal to the scanning direction and, the liquid supply tube is arranged between the first wiring member and the second wiring member.

9. The liquid jetting apparatus according to claim 1, wherein the first wiring member has a lower flexural rigidity than the second wiring member; and the first wiring member includes a shield member along the longitudinal direction of the first wiring member to cover the jetting-data transmission wires.

10. The liquid jetting apparatus according to claim 1, wherein the first wiring member is shorter in length than the second wiring member.

11. The liquid jetting apparatus according to claim 1, further comprising a carriage configured to move in a scanning direction, wherein the liquid jetting head is mounted on the carriage; the first plane is orthogonal to a nozzle surface in which the nozzles are formed, of the liquid jetting head; the second plane is parallel to the nozzle surface; and the second wiring member is pulled out from the carriage in a pullout orientation in the scanning direction, and bent to turn around to the opposite side from the pullout orientation.

12. The liquid jetting apparatus according to claim 11, further comprising a liquid receiving member arranged in the main body at one end of the moving range of the carriage in the scanning direction, wherein the second wiring member is arranged to bend in a transporting direction orthogonal to the scanning direction such that with the liquid jetting head facing the liquid receiving member, a part of the second wiring member stand away from the first wiring member.

* * * * *